US009177494B2

(12) United States Patent
Shapiro et al.

(10) Patent No.: US 9,177,494 B2
(45) Date of Patent: Nov. 3, 2015

(54) FLAG STABILIZER

(71) Applicants: Ronald Marc Shapiro, Pasadena, MD (US); Nancy Carol Zellmer, Pasadena, MD (US)

(72) Inventors: Ronald Marc Shapiro, Pasadena, MD (US); Nancy Carol Zellmer, Pasadena, MD (US)

(73) Assignee: Nancy Carol Zellmer, Pasadena, MD (US)

( * ) Notice: Subject to any disclaimer, the term of this patent is extended or adjusted under 35 U.S.C. 154(b) by 297 days.

(21) Appl. No.: 13/786,063

(22) Filed: Mar. 5, 2013

(65) Prior Publication Data

US 2013/0319316 A1 Dec. 5, 2013

Related U.S. Application Data

(60) Provisional application No. 61/689,379, filed on Jun. 5, 2012.

(51) Int. Cl.
*G09F 17/00* (2006.01)

(52) U.S. Cl.
CPC ..... *G09F 17/00* (2013.01); *G09F 2017/0008* (2013.01)

(58) Field of Classification Search
CPC ..... G09F 17/00; G09F 17/0091; G09F 2017/0008
USPC ..... 116/173, 174, 175; 40/218, 604, 617; 446/227, 396
See application file for complete search history.

(56) References Cited

U.S. PATENT DOCUMENTS

| | | | | | |
|---|---|---|---|---|---|
| 643,945 | A | | 2/1900 | Clifford | |
| 695,663 | A | | 3/1902 | Weirich | |
| 1,253,380 | A | | 1/1918 | Hoffman | |
| 1,438,166 | A | * | 12/1922 | Bolander | 116/173 |
| 1,448,299 | A | | 3/1923 | Holliday | |
| 1,470,320 | A | * | 10/1923 | Bolander | 116/173 |
| 1,476,426 | A | | 12/1923 | Short | |
| 1,613,979 | A | * | 1/1927 | Bolander | 116/173 |
| 1,646,467 | A | | 10/1927 | Walton | |
| 2,109,286 | A | * | 2/1938 | Cubby | 49/13 |
| 2,368,783 | A | | 2/1945 | Schillinger | |
| 3,323,486 | A | | 6/1967 | Woolf | |
| 3,941,083 | A | * | 3/1976 | Morse et al. | 116/173 |
| 4,024,833 | A | * | 5/1977 | Pook et al. | 116/173 |
| 4,052,957 | A | * | 10/1977 | Lee | 116/174 |
| 4,455,020 | A | * | 6/1984 | Schnell | 482/106 |
| 4,543,067 | A | * | 9/1985 | Wallen | 434/300 |
| 4,554,885 | A | | 11/1985 | Burny | |

(Continued)

FOREIGN PATENT DOCUMENTS

JP 11024563 A * 1/1999 ..... G09F 1/10

OTHER PUBLICATIONS

E-Z Lettering Service, Search Results for "everwave", Web, 2 pages, Jun. 16, 2014 <http://www.ezlettering.com/searchprods.asp>.

(Continued)

*Primary Examiner* — R. A. Smith
(74) *Attorney, Agent, or Firm* — Staas & Halsey LLP

(57) ABSTRACT

This stabilizer is a simple counterbalanced horizontal member that attached to a flag and is hoisted and lowered like a regular flag requiring no modifications to any external component, such as the flagpole. The flag remains fully unfurled and extended regardless of wind conditions, including indoors. It is simple to set up and use.

14 Claims, 2 Drawing Sheets

Embodiment B

(56) References Cited

U.S. PATENT DOCUMENTS

| | | | | |
|---|---|---|---|---|
| 4,599,965 | A * | 7/1986 | Johnson | 116/209 |
| 4,603,652 | A | 8/1986 | Thibault et al. | |
| 5,237,955 | A | 8/1993 | Jennings | |
| 5,375,555 | A * | 12/1994 | Dolan | 116/174 |
| 5,402,746 | A | 4/1995 | Deschamps | |
| 5,694,733 | A | 12/1997 | Gallemore, II | |
| 5,701,840 | A | 12/1997 | Cross | |
| 5,884,578 | A | 3/1999 | Thostrup et al. | |
| 5,988,100 | A | 11/1999 | Schmitt | |
| 6,015,122 | A | 1/2000 | Qui | |
| 6,481,366 | B1 * | 11/2002 | Patera | 116/209 |
| 6,733,358 | B1 * | 5/2004 | Wuest | 446/236 |
| 6,923,141 | B1 | 8/2005 | Staats et al. | |
| 6,932,022 | B1 * | 8/2005 | Keller et al. | 116/209 |
| 7,082,889 | B2 | 8/2006 | Clark | |
| 7,421,972 | B1 | 9/2008 | Long | |
| 2002/0073914 | A1 | 6/2002 | Kinahan | |
| 2003/0010274 | A1 | 1/2003 | McCudden et al. | |
| 2005/0235902 | A1 * | 10/2005 | Evans | 116/174 |
| 2008/0098951 | A1 * | 5/2008 | Sullivan | 116/173 |
| 2010/0101479 | A1 * | 4/2010 | Grahl et al. | 116/173 |
| 2011/0197803 | A1 * | 8/2011 | May | 116/173 |
| 2012/0111259 | A1 * | 5/2012 | Swisher et al. | 116/173 |

OTHER PUBLICATIONS

E-Z Lettering Service, Light Pole Banners, Web, 5 pages, Jun. 17, 2014 <http://www.ezlettering.com/products.asp?dept=222>.

* cited by examiner

Embodiment A

Banner Clip & Split Ring, both commercially available

Embodiment B

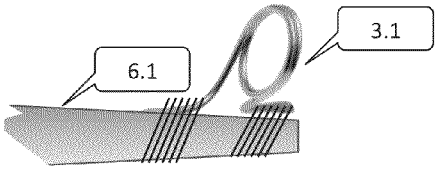

Figure 3A
Guide Ring epoxied and lashed to tapered rod end

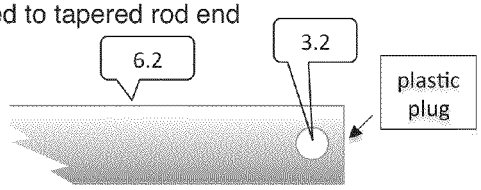

Figure 3B
End of telescoping rod filled solid with plastic plug and drilled

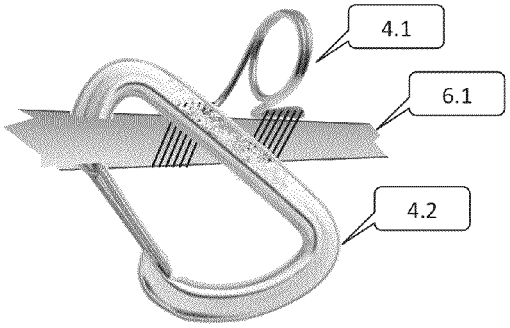

Figure 4A
Guide Ring epoxied and lashed to tapered rod at hoist point. Lanyard hook attaches to Guide Ring. Carabiner attaches to flag grommet.

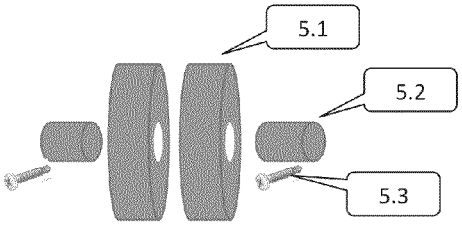

Figure 5A & 5B
Counterweights & retaining collars, size and quantity vary with flag size

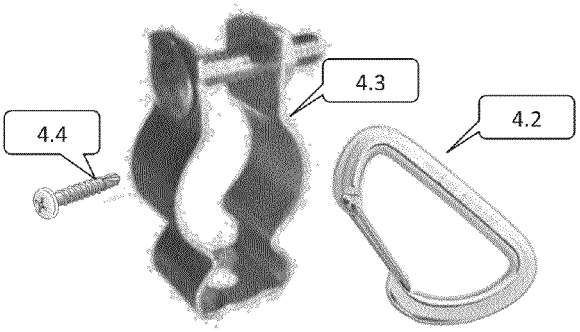

Figure 4B
Clamp assembly clamped and secured to telescoping rod at hoist point. Lanyard hook attaches to thru-bolt. Carabiner goes thru bottom hole and attaches to flag grommet.

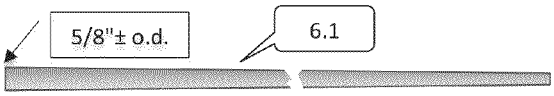

Figure 6A Tapered rod made of fiberglass, carbon fiber, or other material

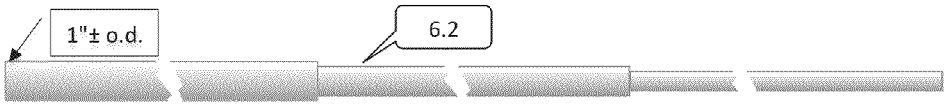

Figure 6B Telescoping rod made of aluminum or other material

FLAG STABILIZER

CROSS-REFERENCE TO RELATED APPLICATIONS

This application is based on and hereby claims priority to U.S. Provisional Application No. 61/689,379 filed on Jun. 5, 2012, the contents of which are hereby incorporated by reference.

BACKGROUND

A flag is typically hung on a flag pole. When a wind blows at a sufficient speed the flag "flies" or waves in the breeze. When the wind does not blow at a sufficient speed the flag hangs limp. It is important that a flag always be shown in its best light and that is when it stands out from the flag pole and waves in the breeze. What is needed is a mechanism that will fly a flag in an insufficient wind or no wind at all so that the flag flies unfurled and fully extended at all times.

SUMMARY

The purpose of the stabilizer is to have the flag stand out from the flagpole even when there is no wind. The stabilizer functions by utilizing a balanced beam attached to the top of the flag maintaining a generally horizontal attitude. The stabilizer is comprised of three major components: the rod, the connectors and the counterweight.

The rod is a significant component of the system. The material composition of the rod varies according to the specific needs of the situation. The rod can be made of graphite. It can also be made of carbon fiber, aluminum, or other materials. The length of the rod is the length of the flag plus 12" for a 4×6 or 3×5 (or smaller) flag. This may have to be increased for larger flags. The 12" butt of the rod is for attachment and adjustment of the counterweight. There is an eyelet at the opposite end of the rod to secure the end of the flag. Optionally, there may be an eyelet at the point of the butt ends for attachment to the halyard.

The connectors attach the flag, the counterweight, and the halyard to the rod. There are two basic methods of attaching the flag. One is a sleeve sewn to the top of the flag, similar to that sewn to the edge of most flags. This would then be slid over the rod and secured to the rod's halyard connector. The other is to suspend the flag from the rod with snap hooks (or similar). This can be accomplished by using a flag clamp or by installing a grommet at each connection point. The number of connections depends on the size of the flag but should be no more than 24" apart. Again, there are two basic methods of attaching to the halyard. One is a built-in eyelet, referred to above. Simply attached the halyard's snap hook to the eyelet. The other is to use a snap hook, carabineer, or some other loop connector. This needs to be stabilized so as not to slide on the rod. This can be accomplished by two nuts on the threaded portion of rod with the connector sandwiched between them. Likewise, there are two basic methods of attaching the counterweight. One is a decorative weight with a hole in the center. This is slipped over the rod's end and secured with two nuts or collars (retainers). The other is to use a snap hook, carabineer, or some other loop connector, slipped over the rod's end and secured between two retainers. This connector goes thru the eye built-in to the counterweight.

The counterweight is what keeps the stabilizer in balance. A weight of high density is held in place by its connector between two retainers on the rod's end. Any symmetrical decorative weight, such as a star, a disc, or a ball, with sufficient mass and a hole in the center is slipped over the rod's buttend and secured with two retainers.

An alternative to having an external counterweight as described above is to have an integral counterweight which is built into the rod, either internal to the rod filling the normally void portion of the rod and/or fabricated as an external surround fixed to the rod. In this case where the counterweight is non-movable the position of the suspension point on the rod would be adjustable, unless the rod with the integral counterweight is designed for a specific flag.

During operation install the grommets or clamps to the flag. Attach the flag to the rod. Attach the rod to the halyard. Temporarily secure the halyard so that the assembly is at chest level. (This may also be done at a temporary location and later moved to the actual halyard.) Place one retainer on the rod and run it all the way up to the halyard connector. Slide the weight (or its connector) about half way up the butt. Place another retainer on the butt. Gently let go of the assembly and check for balance. Slide the counterweight in one direction or the other until the rod remains in a horizontal position. Move the two retainers toward the weight and recheck for balance. When equilibrium is achieved, tighten the two retainers against the weight, and lock in place. Raise the flag and assembly to within a couple of inches of the top of the flagpole, remembering to fasten the lower portion of the flag as normal. Proudly enjoy as your flag presents itself in full glory while others sadly droop on a windless day.

Additional aspects and/or advantages will be set forth in part in the description which follows and, in part, will be apparent from the description, or may be learned by practice of the invention.

BRIEF DESCRIPTION OF THE DRAWINGS

These and/or other aspects and advantages will become apparent and more readily appreciated from the following description of the embodiments, taken in conjunction with the accompanying drawings of which
FIGS. 3A and 4A show fixing.
FIG. 3B shows a tapered rod with a plug.
FIG. 4B shows a clamp assembly.
FIGS. 5A and 5B show counterweights.
FIGS. 6A and 6B show tapered and telescoping rods.

DETAILED DESCRIPTION

Figure 1A:
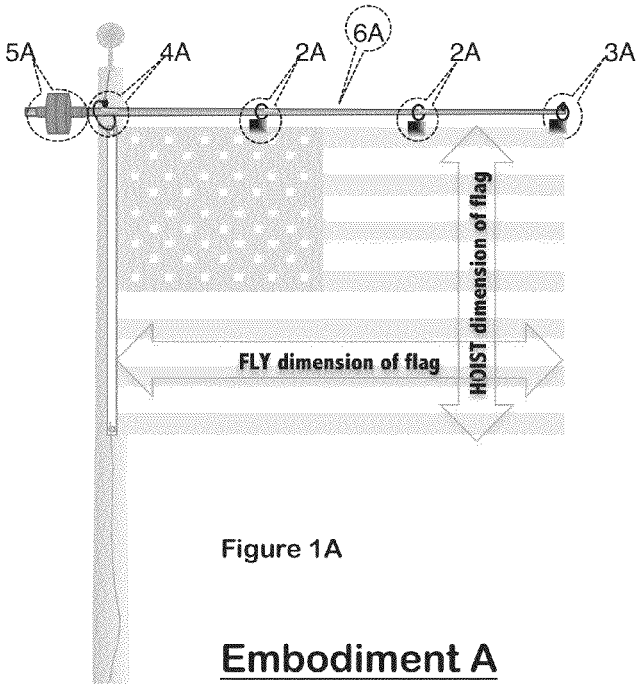
FIGS. 1A and 1B show embodiments.

Reference will now be made in detail to the embodiments, examples of which are illustrated in the accompanying drawings, wherein like reference numerals refer to the like elements throughout. The embodiments are described below to explain the present invention by referring to the figures.

The essence of the current invention is to allow the American Flag, state flag, other national flags or other flags/banners to fly fully unfurled and extended from a flagpole as if there were a steady breeze even when the wind is dead calm. (Hereinafter the term "flag" shall refer to any of the above.) An additional benefit of the current invention is that the flag will not wrap itself around the pole.

This is accomplished through the use of a counterweighted horizontal member, to which the flag is attached and then hoisted as an assembled unit.

While other patented inventions have attempted to accomplish the same goals, they are variously complex, complicated, expensive, non-hoistable, and/or not suited for the retrofit application to existing flagpoles. The current invention requires no modification to either the flagpole or the flag. In fact it may be deployed without a flagpole, for example using a crane hook at a construction site as is often done.

We show here two embodiments. Embodiment A is typically for smaller flags (up to 6' fly), while embodiment B is typically for larger flags (flies 6' and above). However, either embodiment can be made to accommodate any size flag.

Assembly—Preconsumer

In any embodiment, the invention is assembled for the simplest installation and use by the consumer.

Figures 2A, 2B:
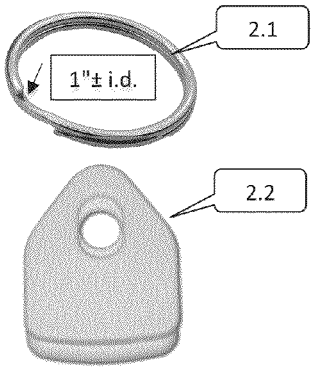
FIGS. 2A and 2B show banner clips and split rings.

Embodiment A—As shown in FIG. 1A starting with a tapered rod 6.1 (see FIG. 6A), a guide ring 3.1 is affixed (see FIG. 3A) to its narrow end and another guide ring 4.1 is affixed approximately 12" from the wider end (see FIG. 4A). A carabineer 4.2 or similar device is placed over the wide end of rod 6.1 and slid toward guide ring 4.1. Several split rings 2.1 are each attached to a banner clip 2.2 (see FIGS. 2A and 2B). Two or more of these assemblies are slid over the end guide ring 3.1 and are free to traverse the length of the rod 6.1. One such assembly is affixed through guide ring 3.1. Screw 5.3 is preinstalled into retaining collar 5.2 (two times). One such assembly is slid over the wide end of rod 6.1 followed by the appropriate number of counterweights 5.1 (see FIG. 5A) and then followed by the other retaining collar 5.2. Screws 5.3 are then tightened to restrain the movement of counterweights 5.1. This embodiment is now ready for the consumer.

Figure 1B:
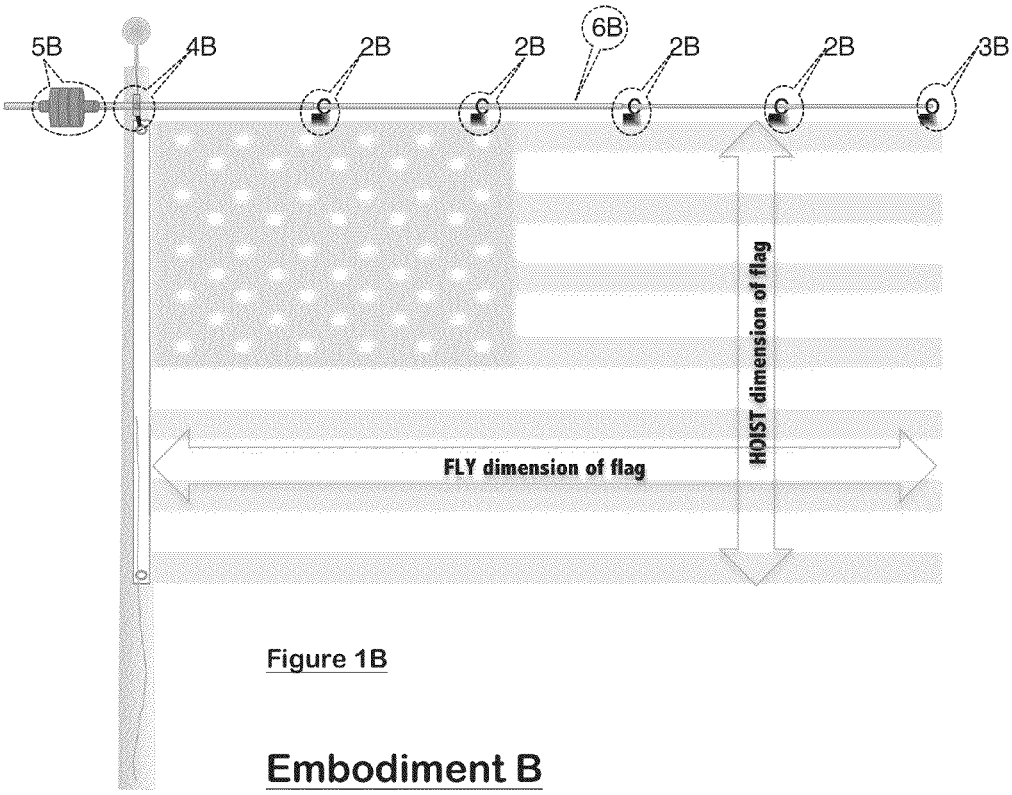

Embodiment B—As shown in FIG. 1B starting with telescoping rod 6.2 (see FIG. 6B) containing a plastic plug at its narrow end (see FIG. 3B), a hole 3.2 is drilled through the narrow end of rod 6.2 and its plastic plug. Clamp assembly 4.3 is installed approximately 18" from the wide end of rod 6.2 (see FIG. 4B) and secured thereto by a screw 4.4. Carabineer 4.2 is then inserted through the hole at the bottom of clamp 4.3. Four or more split rings 2.1 are each attached to a banner clip 2.2 and slid over the narrow end of rod 6.2 and are free to traverse the length of the rod 6.2. One such assembly is attached through hole 3.2. Screw 5.3 is preinstalled into retaining collar 5.2 (two times). One such assembly is slid over the wide end of rod 6.2 followed by the appropriate number of counterweights 5.1 (see FIG. 5B) and then followed by the other retaining collar 5.2. Screws 5.3 are then tightened to restrain the movement of counterweights 5.1. This embodiment is now ready for the consumer.

Assembly—Consumer

Embodiment A—The grommet standard on most flags is attached using carabineer 4.2. The opposite top corner of the flag is secured using clamp 2.2 which is affixed to guide ring 3.1. The remaining clamp assemblies 2.1 & 2.2 are affixed to the top edge of the flag approximately evenly spaced. The flagpole's halyard's snap hooks are attached to guide ring 4.1 and the flag's bottom grommet, respectively. The assembly is then hoisted to approximately shoulder level and temporarily cleated off. Screws 5.3 are backed off but not removed and the location of the counterweights 5.1 is adjusted to bring the total assembly with the flag into a level horizontal position. Retaining collars 5.2 are then slid tight against counterweights 5.1 and securely fixed in position by screws 5.3. The entire assembly is then hoisted to the top of the flagpole where it displays proudly regardless of wind condition.

Embodiment B—The grommet standard on most flags is attached using carabineer 4.2. The opposite top corner of the flag is secured using clamp 2.2, which is affixed through whole 3.2. The rod 6.2 is then telescoped out to bring the flag taught and locked into position. The remaining clamp assemblies 2.1 & 2.2 are affixed to the top edge of the flag approximately evenly spaced. The flagpole's halyard's snap hooks are attached to the top of clamp assembly 4.3 and the flag's bottom grommet, respectively. The assembly is then hoisted to approximately shoulder level and temporarily cleated off. Screws 5.3 are backed off but not removed and the location of the counterweights 5.1 is adjusted to bring the total assembly with the flag in to a level horizontal position. Retaining collars 5.2 are then slid tight against counterweights 5.1 and securely fixed in position by screws 5.3. The entire assembly is then hoisted to the top of the flagpole where it displays proudly regardless of wind condition.

In another embodiment, similar to embodiment A or B, but to be completely assembled for the consumer, the split rings 2.1 and banner clips 2.2 are eliminated in favor of a sleeve sewn to the top of the flag. The flag is then slid over the rod 6.1 with its top grommet affixed to carabineer 4.2. The counterweights 5.1 and retaining collars 5.2 are preset for the flag provided, however they remain relocatable should the need arise. All the user need do is attach the flagpole's halyard's snap hooks to guide ring 4.1 and the flag's bottom grommet, respectively. The entire assembly is then hoisted to the top of the flagpole where it displays proudly regardless of wind condition.

In any embodiment, after initial setup, the assembly with the flag is hoisted and flown or lowered and removed in the same manner as is typical for a flag without any embellishment. That is to say, all that is required is the attachment/detachment of the two snap hooks.

Alternates or possible improvements involve having the counterweight integrated or built into the rod as a non-moveable element. This integrated counterweight can be either internal to the rod filling the normally void portion of the rod and/or fabricated as an external surround fixed to the rod. In this case where the counterweight is non-movable the position of the suspension point on the rod would be adjustable, unless the rod with the integral counterweight is designed for a specific flag.

The shape of the weight can also change, for instance an eagle or star instead of the circular plates shown in the drawings. The weights can be suspended instead of having them on the rod. The stabilizer can have a solar powered LED strip to illuminate the flag at night. An absorbent quick drying material can be used as a counterbalance when the flag has gotten wet. A sleeve can be added to a flag so that it can be slipped onto the horizontal member thus making middle clamps or hooks unnecessary. Grommets can be added to the flag so that middle clamps or hooks become unnecessary. It is possible to add additional devices under the first device so that more than one flag can be flown at a time. It is also possible that instead of a weight a line is tied to the end where the weight would have gone and cleat the line so that the flag flies without the use of the weight.

A snap hook can be used instead of a split ring (although this adds weight). The carabineer can be replaced with a snap hook or a variety of similar devices and materials. A cable or wire could be added between the ring and clamp if additional separation is desired. This would also facilitate the application for a non-rectangular flag, for example varying lengths of cable can be used to support a triangular or trapezoidal flag. The device could be used to support banners designed for decoration, sales promotions, warnings or other information. The components could be manufactured in a variety of colors The apparatus provides a simple counterbalanced horizontal member which is independent of the structure. The stabilizer can go up any diameter of flagpole whether straight or tapered (most commercial flagpoles have a Venetian entasis taper). The stabilizer can be raised without a flagpole (on a crane hook or building overhang). The flag is fully supported along the top edge whereas some of the others only support a portion causing the flag to then partially droop. The stabilizer allows the flag to rotate fully about the flagpole whereas some others have limited rotation.

Because of the simplicity of design initial assembly is quite simple requiring no external modifications. Also because of the simplicity of design, after initial setup, it is as easy to use as hoisting and lowering a regular flag, with no additional steps.

Again because of the simplicity of design, not only is it less costly to produce but also less costly to implement It presents the flag fully unfurled and extended with no distractions from other bulky apparatus or additional bars while still allowing the flag to undulate gently or vigorously with wind conditions. This is how the flag presents at its finest.

This device uses the idea of counterbalancing to accomplish the purpose of being able to fly a flag unfurled regardless of wind conditions. As a result weights are used in this device for the purpose of counterbalancing. This device allows the flag to be flown from flagpoles regardless of the flagpole's diameter. This device allows the flag to rotate fully without wrapping around the flagpole. This device also acts as a tell-tail or weather vane because of its ability to rotate fully. The basic ease of use, cost effectiveness, ability to use on flagpoles without modification needed external to the device and the beauty of seeing the flag always unfurled makes it unlike any previous invention Although a few embodiments have been shown and described, it would be appreciated by those skilled in the art that changes may be made in these embodiments without departing from the principles and spirit of the invention, the scope of which is defined in the claims and their equivalents.

The invention claimed is:

1. A flag stabilizer for a flag comprising:

a rod suspended from a single suspension point and to which the flag could be attached, the rod not constrained except at the single suspension point; and a counterweight affixed to the end of the rod opposite the flag relative to the suspension point.

2. A stabilizer as recited in claim 1, further comprising attachment devices comprising:

guide rings attached to the rod; and banner clips attached to the guide rings and flag.

3. A stabilizer as recited in claim 2, further comprising split rings attached to the banner clips and guide rings.

4. A stabilizer as recited in claim 1, further comprising attachment devices comprising:

a sleeve incorporated into the edge of the flag and slid over the rod.

5. A stabilizer as recited in claim 1, where the rod is one of, or a combination of:

cylindrical; tapered; and telescoping.

6. A stabilizer as recited in claim 1, wherein the rod is comprised of one of, or a combination of: metal; graphite; carbon fiber; fiberglass; and other materials.

7. A stabilizer as recited in claim 1, further comprising:

a ring attached to the rod at the suspension point; and a carabineer connecting the rod and a flag grommet.

8. A stabilizer as recited in claim 1, further comprising:

a clamp attached to the rod at the suspension point; and a clamp connecting the rod and a flag grommet.

9. A stabilizer as recited in claim 1, further comprising a pair of retaining collars attached to the rod and abutting the counterweight.

10. A stabilizer as recited in claim 1, wherein the counterweight is inside the rod.

11. A stabilizer as recited in claim 1, wherein the counterweight is integrated into the rod.

12. A flag stabilizer for a flag comprising:

a rod suspended from a single suspension point and to which the flag could be attached, the rod not constrained except at the single suspension point;

a counterweight attached to the end of the rod opposite the flag relative to the single suspension point;

guide rings attached to the rod;

banner clips attached to the guide rings and the flag;

a sleeve incorporated into the edge of the flag and slid over the rod;

split rings attached to the banner clips and guide rings;

the rod is one of, or a combination of cylindrical, tapered, telescoping;

the rod is comprised of metal, graphite, carbon fiber, fiberglass, other materials, or a combination thereof;

a ring attached to the rod at the single suspension point;

a carabineer connecting the rod and a flag grommet;

a clamp attached to the rod at the single suspension point;

a clamp connecting the rod and a flag grommet; and a pair of retaining collars attached to the rod and abutting the counterweight.

13. A stabilizer as recited in claim 12, wherein the counterweight is integrated into the rod.

14. A flag stabilizer for a flag comprising:

a counterweighted rod to which the flag could be attached and which could be suspended from a single suspension point, the counterweighted rod not constrained except at the single suspension point.

* * * * *